US008435707B2

(12) United States Patent
Tu et al.

(10) Patent No.: US 8,435,707 B2
(45) Date of Patent: May 7, 2013

(54) TONER ADDITIVE COMPRISING CARBON-SILICA DUAL PHASE PARTICLES

(75) Inventors: Hairuo Tu, Boxborough, MA (US); Dmitry Fomitchev, Lexington, MA (US); Jinsong Liu, Franklin, MA (US); Zhifeng Li, Westford, MA (US); James Boswell, Nashua, NH (US)

(73) Assignee: Cabot Corporation, Boston, MA (US)

( * ) Notice: Subject to any disclaimer, the term of this patent is extended or adjusted under 35 U.S.C. 154(b) by 169 days.

(21) Appl. No.: 13/161,641

(22) Filed: Jun. 16, 2011

(65) Prior Publication Data

US 2012/0322002 A1 Dec. 20, 2012

(51) Int. Cl.
*G03G 9/08* (2006.01)

(52) U.S. Cl.
USPC ..... 430/108.1; 430/108.3; 430/108.7

(58) Field of Classification Search ..... 430/108.1, 430/108.3, 108.7
See application file for complete search history.

(56) References Cited

U.S. PATENT DOCUMENTS

| | | | |
|---|---|---|---|
| 4,014,844 | A | 3/1977 | Vidal et al. |
| 5,554,739 | A | 9/1996 | Belmont |
| 5,571,654 | A | 11/1996 | Ong |
| 5,707,432 | A | 1/1998 | Adams et al. |
| 5,837,045 | A | 11/1998 | Johnson et al. |
| 5,851,280 | A | 12/1998 | Belmont et al. |
| 5,885,335 | A | 3/1999 | Adams et al. |
| 5,895,522 | A | 4/1999 | Belmont et al. |
| 5,900,029 | A | 5/1999 | Belmont et al. |
| 5,922,118 | A | 7/1999 | Johnson et al. |
| 6,042,643 | A | 3/2000 | Belmont et al. |
| 6,057,387 | A | 5/2000 | Mahmud et al. |
| 6,068,688 | A | 5/2000 | Whitehouse et al. |
| 6,103,380 | A | 8/2000 | Devonport |
| 6,169,129 | B1 | 1/2001 | Mahmud et al. |
| 6,191,194 | B1 | 2/2001 | Anand et al. |
| 6,337,358 | B1 | 1/2002 | Whitehouse et al. |
| 6,350,519 | B1 | 2/2002 | Devonport |
| 6,368,239 | B1 | 4/2002 | Devonport et al. |
| 6,372,820 | B1 | 4/2002 | Devonport |
| 6,458,458 | B1 | 10/2002 | Cooke et al. |
| 6,479,571 | B1 | 11/2002 | Cooke et al. |
| 6,551,393 | B2 | 4/2003 | Devonport et al. |
| 6,586,501 | B1 | 7/2003 | Dalton et al. |
| 6,664,312 | B2 | 12/2003 | Devonport |
| 6,852,158 | B2 | 2/2005 | Belmont et al. |
| 7,655,372 | B2 | 2/2010 | Step et al. |
| 2006/0211791 | A1 | 9/2006 | Burns et al. |
| 2010/0009280 | A1 | 1/2010 | Liu et al. |

FOREIGN PATENT DOCUMENTS

| | | |
|---|---|---|
| EP | 0272127 | 6/1988 |
| EP | 0749991 | 12/1996 |
| WO | WO 99/23174 | 5/1999 |
| WO | WO 99/63007 A1 | 12/1999 |
| WO | WO 00/68321 A1 | 11/2000 |
| WO | WO 2010/065075 A1 | 6/2010 |

OTHER PUBLICATIONS

International Search Report and the Written Opinion of the International Searching Authority, or the Declaration for International Application No. PCT/US2012/041627, mailed on Sep. 21, 2012.

Nash R. J., et al., "Toner Charge Instability", IS&T's Tenth International Congress on Advances in Non-Impact Printing Technologies, 1994, pp. 95-107.

Veregin R. P. N., et al., "The Role of Water in the Triboelectric Charging of Alkylchlorosilane-Treated Silicas as Toner Surface Additives", Journal of Imaging Science and Technology, vol. 39, No. 5, The Society for Imaging Science and Technology, 1995, pp. 429-432.

Wang, et al., "Effect of Functionalization of Carbon Black on Rubber Properties- Using CSDPF 2000 and CSDPF 4000 to improve Global Compromise between Rolling Resistance, Wear Resistance, and Wet Skid Resistance for Tires", Presented at "Functional Tire Fillers 2011", Fort Lauderdale, Florida, Jan. 29-31, 2011.

*Primary Examiner* — Hoa V Le

(57) ABSTRACT

The invention provides a toner composition comprising resin particles, a colorant, and a toner additive, wherein the toner additive comprises carbon-silica dual phase particles, wherein the carbon-silica dual phase particles comprise aggregates of carbon black comprising at least one silicon-containing region, and wherein the carbon-silica dual phase particles are distributed on the surface of the resin particles. The invention also provides a method of preparing the aforesaid toner composition.

30 Claims, No Drawings

TONER ADDITIVE COMPRISING CARBON-SILICA DUAL PHASE PARTICLES

BACKGROUND OF THE INVENTION

Electrophotographic image formation comprises uniform charging of the surface of a photoreceptor drum or belt; exposure of the photoreceptor surface to light and formation on the photoreceptor surface of a charge pattern, i.e., a latent image, that mirrors the information to be transferred into a real image; developing the latent image with electrostatically charged toner particles comprising a colorant dispersed in a binder resin; transferring the developed toner onto a substrate, e.g. paper; fusing the image onto a substrate; and preparing the photoreceptor surface for the next cycle by erasing the residual electrostatic charges and cleaning the remaining toner particles.

Toners for use in electrophotography and electrostatic printing include a binder resin and a colorant, and may further include a charge control agent, an offset-preventing agent, and other additives. External toner additives such as metal oxide particles are often combined with toner particles in order to improve selected properties of the toner particles, including fluidity, transferability, fixability, and cleaning properties. Typically, the metal oxide particles, e.g., silica, alumina, or titania, are subjected to a chemical treatment to render the surface of the metal oxide particles hydrophobic. In addition, the metal oxide particles strongly influence the chargeability, i.e., tribocharge, of the toner composition. For example, toner containing silica as an additive exhibits higher absolute levels of tribocharge than toner containing titania. However, the tribocharge of silica is sensitive to humidity conditions. Such a dependence of the tribochargeability on environmental conditions leads to impaired transferability of the image and ultimately to reduced image quality.

Thus, it is desirable to have an external toner additive that exhibits high tribocharge that is stable with respect to environmental conditions.

BRIEF SUMMARY OF THE INVENTION

The invention provides a toner composition comprising resin particles, a colorant, and a toner additive, wherein the toner additive comprises carbon-silica dual phase particles, wherein the carbon-silica dual phase particles comprise aggregates of carbon black comprising at least one silicon-containing region, and wherein the carbon-silica dual phase particles are distributed on the surface of the resin particles.

The invention also provides a method of preparing a toner composition, which method comprises (a) providing carbon-silica dual phase particles, wherein the carbon-silica dual phase particles comprise aggregates of carbon black comprising at least one silicon-containing region, (b) providing resin particles comprising at least one colorant, providing resin particles comprising at least one colorant, wherein the resin particles have a surface, and (c) combining the carbon-silica dual phase particles with the resin particles so that the carbon-silica dual phase particles become distributed on the surface of the resin particles, thereby providing a toner composition.

DETAILED DESCRIPTION OF THE INVENTION

In one embodiment, a toner composition comprises resin particles, a colorant, and a toner additive, wherein the toner additive comprises carbon-silica dual phase particles, wherein the carbon-silica dual phase particles comprise aggregates of carbon black comprising at least one silicon-containing region, and wherein the carbon-silica dual phase particles are distributed on the surface of the resin particles. The at least one silicon-containing region exists at the surface of and/or within the carbon black aggregates.

In another embodiment, a method of preparing a toner composition includes (a) providing carbon-silica dual phase particles, wherein the carbon-silica dual phase particles comprise aggregates of carbon black comprising at least one silicon-containing region, (b) providing resin particles comprising at least one colorant, wherein the resin particles have a surface, and (c) combining the carbon-silica dual phase particles with the resin particles so that the carbon-silica dual phase particles become distributed on the surface of the resin particles, thereby providing a toner composition.

For both the method and the toner composition, at least one organic group may be attached to the carbon-silica dual phase particles. In certain embodiments, the at least one organic group is selected from the group consisting of an aliphatic group, an aromatic group, a heterocyclic group, and a heteroaryl group. In certain embodiments, the at least one organic group is substituted with a moiety selected from the group consisting of R, OR, COR, COOR, OCOR, X, $CX_3$, $C_nH_{2n+1-y}X_y$, where n is 1 to 5, y is 1 to 2n+1, and X is halogen, CN, $NR_2$, $SO_2NR(COR)$, $SO_2NR_2$, NR(COR), $CONR_2$, $NO_2$, $SO_3M$ (wherein M is H, Li, Na, Cs, or K), $SO_3NR_4^+$, and N═NR', where R is independently hydrogen, $C_1$-$C_{20}$ substituted or unsubstituted alkyl (branched or unbranched), $C_2$-$C_{20}$ substituted or unsubstituted alkenyl, $(C_2\text{-}C_4 \text{ alkyleneoxy})_xR''$, wherein x is 1 to 40, or a substituted or unsubstituted aryl, R' is independently hydrogen, $C_1$-$C_{20}$ substituted or unsubstituted alkyl (branched or unbranched), or a substituted or unsubstituted aryl, and R" is hydrogen, a $C_1$-$C_{20}$ substituted or unsubstituted alkyl, a $C_3$-$C_{20}$ substituted or unsubstituted alkenyl, a $C_1$-$C_{20}$ substituted or unsubstituted alkanoyl, and a substituted or unsubstituted aroyl. In certain embodiments, the organic group is substituted with a moiety selected from the group consisting of fluoro, $CF_3$, or $C_nH_{2n+1-y}F_y$, wherein n is 1 to 5 and y is 1 to 2n−1.

For both the method and the toner composition, the carbon-silica dual phase particles may have been treated with a surface-treating agent that is associated with the at least one silicon-containing region. In certain embodiments, the surface-treating agent comprises a silicone fluid. In certain embodiments, the silicone fluid comprises a non-functionalized silicone fluid. In certain preferred embodiments, the non-functionalized silicone fluid is selected from the group consisting of polydimethylsiloxanes, polydiethylsiloxanes, phenylmethylsiloxane copolymers, fluoroalkylsiloxane copolymers, diphenylsiloxane-dimethylsiloxane copolymers, phenylmethylsiloxane-dimethylsiloxane copolymers, phenylmethylsiloxane-diphenylsiloxane copolymers, methylhydrosiloxane-dimethylsiloxane copolymers, polyalkylene oxide modified silicones, and cyclic polysiloxanes.

For both the method and the toner composition, the surface-treating agent may include a functionalized silicone fluid. In certain preferred embodiments, the functionalized silicone fluid comprises functional groups selected from the group consisting of vinyl, hydride, silanol, amino, and epoxy.

For both the method and the toner composition, the surface-treating agent may include a hydrophobizing silane and/or a silazane. In certain embodiments, the hydrophobizing silane has the general formula $R_{4-n}SiX_n$ wherein n is 1-3, each R is independently selected from the group consisting of hydrogen, a $C_1$-$C_{18}$ alkyl group, a $C_3$-$C_{18}$ haloalkyl group, and a $C_6$-$C_{14}$ aromatic group, and each X is independently a $C_1$-$C_{18}$ alkoxy group or halo.

For both the method and the toner composition, the surface-treating agent may include a functionalized silane. In accordance with more preferred embodiments, the functionalized silane comprises at least one functional group selected from the group consisting of acrylate, methacrylate, amino, anhydride, epoxy, halogen, hydroxyl, sulfur, vinyl, and isocyanate, and combinations thereof.

In accordance with any of the above embodiments, the toner composition may include about 0.1 wt. % to about 5 wt. % of the toner additive (i.e., the carbon-silica dual phase particles). In accordance with any of the above embodiments, the colorant may be at least one pigment selected from the group consisting of carbon black, magnetites, and combinations thereof.

As is generally known to those skilled in the art, carbon blacks are produced in a furnace-type reactor by pyrolyzing a hydrocarbon feedstock with hot combustion gases. The produced carbon black exists in the form of aggregates of carbon black particles. Similarly, fumed silica exists in the form of aggregates, which are formed of silica primary particles that do not generally exist independently of the silica aggregate. The carbon-silica dual phase particles do not represent a mixture or blend of discrete carbon black and silica aggregates. Rather, the carbon-silica dual phase particles include at least one silicon-containing region, either at the surface of or within the carbon black aggregate.

The carbon-silica dual phase particles may be produced by manufacturing the carbon black in the presence of silicon-containing compounds. Such silicon-treated carbon blacks can be prepared, for example, by the methods disclosed in U.S. Pat. No. 6,057,387, which is incorporated herein by reference. Typically, carbon blacks are produced in a staged furnace reactor, including a combustion zone, a converging diameter zone, a restricted diameter feedstock injection zone, and a reaction zone. Hot combustion gases are generated in the combustion zone by contacting a liquid or gaseous fuel with a suitable oxidant stream, such as air, oxygen, or mixtures thereof. The oxidant stream may be preheated to facilitate the generation of hot combustion gases. Any readily combustible gas, vapor, or liquid stream, including natural gas, hydrogen, methane, acetylene, alcohols, or kerosene, may be used to contact the oxidant in the combustion zone to generate hot combustion gases. Preferably, fuels having high carbon content, such as hydrocarbons, petroleum refinery oils from catalytic cracking operations, as well as coking and olefin manufacturing operation by-products, are burned in the combustion zone. The ratio of oxidant to fuel varies with the type of fuel utilized. For example, when natural gas is used, the ratio of oxidant to fuel can be from about 10:1 to about 1000:1.

Once generated, the hot combustion gas stream is directed into the reactor in the reaction zone. The carbon black feedstock stream is introduced into the reactor in the injection zone. Typically, the feedstock is injected into the hot combustion gas stream through nozzles designed for optimum distribution of the feedstock. A single- or bi-fluid nozzle may be used to atomize the feedstock. The carbon black is then produced by pyrolysis, or partial combustion, in the reaction zone as the feedstock and the hot combustion gases are mixed. A cooling fluid, such as water, is then sprayed into the gas stream containing the formed carbon black particles, in a quench zone that is positioned downstream of the reaction zone. The quench is used to decrease the reaction rate and cool the carbon black particles. The quench stream is positioned at a predetermined distance from the reaction zone; alternatively, a plurality of quench streams may be positioned throughout the reactor. After the carbon black is sufficiently cooled, the product is separated and recovered by conventional methods. The separation of the carbon black from the gas stream is readily accomplished by conventional means such as a precipitator, cyclone separator, bag filter, or other means known to those skilled in the art.

The carbon-silica dual phase particles are produced by introducing a volatilizable silicon-containing compound into the carbon black reactor at a point upstream of the quench zone. Preferably, the silicon-containing compound is volatilizable at carbon black reactor temperatures. Non-limiting examples of suitable silicon-containing compounds include tetraethoxyorthosilicate (TEOS), silanes (such as alkoxysilanes, alkylalkoxysilanes, and aryl-alkylalkoxysilanes), silicone oil, polysiloxanes and cyclic polysiloxanes (such as octamethylcyclotetrasiloxane (OMTS), decamethylcyclopentasiloxane, dodecamethylcyclohexasiloxane, and hexamethylcyclotrisiloxane), and silazanes (such as hexamethyldisilazane). Examples of suitable silanes include tetramethoxysilane, tetraethoxysilane, methyltrimethoxysilane, methyltriethoxysilane, dimethyldimethoxysilane, dimethyldiethoxysilane, trimethylmethoxysilane, trimethylmethoxysilane, diethylpropylethoxysilane, and halogen-organosilanes such as, for example, tetrachlorosilane, trichloromethylsilane, dimethyldichlorosilane, trimethylchlorosilane, methylethyldichlorosilane, dimethylethylchlorosilane, and dimethylethylbromosilane. Besides volatilizable compounds, decomposable silicon-containing compounds which are not necessarily volatilizable can also be used to yield the silicon-treated carbon black. Other suitable silicon-containing compounds that can be used to yield the silica-treated carbon black include cyclic polysiloxanes of the types D3, D4, and D5, and polysiloxanes or silicone oils, many of which are well known in the art. The usefulness of these compounds can be readily determined by their volatilizability and/or decomposability. Low molecular weight silicon-containing compounds are preferred.

The silicon-containing compound may be premixed with the carbon black feedstock and introduced into the reactor through the feedstock injection zone. Alternatively, the silicon-containing compound may be introduced into the reactor separately, either upstream or downstream from the feedstock injection zone. The silicon-containing compound, however, must be introduced upstream from the quench zone. Upon volatilization, and exposure to the high reactor temperatures, the silicon-containing compound decomposes within the reaction zone and forms the carbon-silica dual phase particles, such that silica becomes an intrinsic part of the carbon black. If the silicon-containing compound is introduced substantially simultaneously with the feedstock, the silica-containing regions are distributed throughout at least a portion of the carbon black aggregate. The silicon-containing compound may alternatively be introduced to the reaction zone at a point after carbon black formation has commenced but before it has been subjected to the quench. In such an event, carbon-silica dual phase particles are obtained in which silica or a silicon-containing species is present primarily at or near the surface of the carbon black aggregate.

In the carbon-silica dual phase particles useful in the invention, silicon or a silicon-containing species, including but not limited to, silicon oxides, e.g., $SiO_2$ and silicon carbides, may be distributed through at least a portion of the carbon black aggregate as an intrinsic part of the carbon black. When the carbon-silica dual phase particles are examined under STEM-EDX (Scanning Transmission Electron Microscope—Energy Dispersive X-ray), the silicon signal corresponding to the silicon-containing species is found to be present in individual carbon black aggregates. By comparison, in a physical mixture of silica and carbon black, STEM-EDX examination reveals distinctly separate silica and carbon black aggregates.

The silicon concentration in the carbon-silica dual phase particles generally is determined by the flow rate of the silicon-containing compound into the reactor. Typically, the carbon-silica dual phase particles contain between about 0.1 and about 25 wt. % silicon, preferably between about 0.5 and about 25 wt. % silicon (e.g., between about 1 and about 25 wt. % silicon, or between about 2 and about 20 wt. % silicon, or between about 3 and about 15 wt. % silicon, or between about 6 and about 10 wt. % silicon).

The resulting carbon-silica dual phase particles are conductive, providing these materials unique properties in comparison to silica and titania. Furthermore, the surfaces of the particles may be treated to modify the surface properties, for example, to render the hydrophilic silica portions of the particle surface hydrophobic.

The carbon-silica dual phase particles may have varying proportions of carbon and silica at their surfaces. For example, the surface may be from about 10% to about 90% silica, for example, from about 10% to about 25%, about 25% to about 35%, about 35% to about 45%, about 45% to about 55%, about 55% to about 65%, about 65% to about 75%, or about 75% to about 90% silica. The surface of the carbon-silica dual phase particles may be modified by attaching or adsorbing a chemical group. In general, different surface treating agents will react differently with the carbon and silica portions of the particle surface.

For example, the carbon-silica dual phase particles may be modified to attach a chemical group, for example, an organic group, preferentially to the carbon portion of the surface. Such carbon-silica dual phase particles may be prepared using any method known to those skilled in the art. Such carbon-silica dual phase particles can be prepared, for example, by methods disclosed in U.S. Pat. Nos. 5,554,739, 5,707,432, 5,837,045, 5,851,280, 5,885,335, 5,895,522, 5,900,029, 5,922,118, 6,042,643, 6,337,358, 6,350,519, 6,368,239, 6,372,820, 6,551,393, and 6,664,312, International Patent Application Publication WO 99/23174, and U.S. Patent Application Publication 2006/0211791. In such methods, the organic group or other material being attached to the carbon-silica dual phase particles and the carbon-silica dual phase particles are combined. An aqueous solution of a nitrite and an acid are then added separately or together to generate the diazonium reaction and form the diazonium salt, which reacts with the carbon surface of the carbon-silica dual phase particles. This generation of the diazonium salt is preferably accomplished in situ with the carbon-silica dual phase particles. In the diazonium reaction, the primary amine group will react via a diazonium salt to form nitrogen gas or other by-products, which will then permit the organic group to attach onto the pigment. Other methods for preparing the modified carbon-silica dual phase particles include reacting carbon-silica dual phase particles having available functional groups with a reagent including the organic group. Such modified carbon-silica dual phase particles may also be prepared using the methods described in the references discussed above.

Furthermore, the treated carbon-silica dual phase particles can be formed by using the diazonium and stable free radical methods described, for example, in U.S. Pat. Nos. 6,068,688; 6,337,358; 6,368,239; 6,551,393; and 6,852,158, which make use of reacting at least one radical with at least one particle, wherein a radical is generated from the interaction of at least one transition metal compound with at least one organo-halide compound in the presence of one or more particles capable of radical capture, and the like.

In certain embodiments, radical addition can be used to attach chemical groups onto the surface of the carbon-silica dual phase particles. This technique is described, for example, in U.S. Pat. No. 4,014,844.

In certain embodiments, an epoxy reaction can be used to attach chemical groups. For example, the process described in EP 0272127 and EP 0749991 can be used to attach chemical groups onto the surface of the carbon-silica dual phase particles.

When the carbon-silica dual phase particles have at least one organic group attached thereto, the organic group may be an aliphatic group, an aromatic group, a heterocyclic group, or a heteroaryl group. The organic group may be substituted or unsubstituted. Aliphatic groups are hydrocarbon-based groups which may contain from 1 to about 20 carbon atoms and may be saturated (i.e., alkyl groups) or may contain one or more unsaturated sites (i.e., alkenyl and/or alkynyl groups). The aliphatic groups can be branched or unbranched and can be acyclic or cyclic. Non-limiting examples of suitable acyclic aliphatic groups include alkyl groups, alkenyl groups, and alkynyl groups. Non-limiting examples of suitable cyclic aliphatic groups include cycloalkyl groups (e.g., cyclopropyl, cyclobutyl, cyclopentyl, cyclohexyl, cycloheptyl, cyclooctyl, and the like) and cycloalkenyl groups (e.g., cyclopentenyl and cyclohexenyl).

The term "aromatic group" refers to an unsubstituted or substituted aromatic carbocyclic substituent, as commonly understood in the art, and includes phenyl and naphthyl groups. It is understood that the term aromatic applies to cyclic substituents that are planar and comprise $4n+2\pi$ electrons, according to Hückel's Rule.

The term "heterocyclic," as used herein, refers to a monocyclic or bicyclic 5- or 6-membered ring system containing one or more heteroatoms selected from the group consisting of O, N, S, and combinations thereof. The heterocyclic group can be any suitable heterocyclic group and can be an aliphatic heterocyclic group, an aromatic heterocyclic group, or a combination thereof. Aromatic heterocyclic groups are referred to herein as heteroaryl groups. The heterocyclic group can be a monocyclic heterocyclic group or a bicyclic heterocyclic group. Suitable bicyclic heterocyclic groups include monocylic heterheterocyclic ocyclyl rings fused to a $C_6$-$C_{10}$ aryl ring. When the heterocyclic group is a bicyclic heterocyclic group, both ring systems can be aliphatic or aromatic, or one ring system can be aromatic and the other ring system can be aliphatic as in, for example, dihydrobenzofuran. Non-limiting examples of suitable heteroaryl groups include furanyl, thiopheneyl, pyrrolyl, pyrazolyl, imidazolyl, 1,2,3-triazolyl, 1,2,4-triazolyl, isoxazolyl, oxazolyl, isothiazolyl, thiazolyl, pyridinyl, pyrimidinyl, pyrazinyl, triazinyl, benzofuranyl, benzothiopheneyl, indolyl, quinolinyl, isoquinolinyl, benzimidazolyl, benzoxazolinyl, benzothiazolinyl, and quinazolinyl. The heterocyclic group is optionally substituted with 1, 2, 3, 4, or 5 substituents as recited herein, wherein the optional substituent can be present at any open position on the heterocyclic group.

When the organic group is substituted, typically it may contain any functional group compatible with the particular reaction used to attach the organic group to the carbon-silica dual phase particles. Functional groups compatible with the formation of a diazonium salt include, but are not limited to, R, OR, COR, COOR, OCOR, X, $CX_3$, $C_nH_{2n+1-y}X_y$, where n is 1 to 5, y is 1 to 2n+1, and X is halogen (e.g., Cl, F, I, or Br), CN, $NR_2$, $SO_2NR(COR)$, $SO_2NR_2$, NR(COR), $CONR_2$, $NO_2$, $SO_3M$ (wherein M is H, Li, Na, Cs, or K), $SO_3NR_4^+$, and N═NR', where (a) R is independently hydrogen, $C_1$-$C_{20}$ substituted or unsubstituted alkyl (branched or unbranched), $C_2$-$C_{20}$ substituted or unsubstituted alkenyl, ($C_2$-$C_4$ alkyleneoxy)$_x$R", wherein x is 1 to 40, or a substituted or unsubstituted aryl, (b) R' is independently hydrogen, $C_1$-$C_{20}$ substituted or unsubstituted alkyl (branched or unbranched), or a substituted or unsubstituted aryl, and (c) R" is hydrogen, a $C_1$-$C_{20}$ substituted or unsubstituted alkyl, a $C_3$-$C_{20}$ substituted or unsubstituted alkenyl, a $C_1$-$C_{20}$ substituted or unsubstituted alkanoyl, or a substituted or unsubstituted aroyl. The integer x is from 1 to 40 and is preferably from 2 to 25. The organic group may be substituted more than once. For example, the organic group may be a phenyl group substituted at one or more of the para, meta, or ortho positions with fluoro, $CF_3$, or $C_nH_{2n+1-y}F_y$, where y and n are as defined above. The carbon-silica dual phase particles may be modified carbon-silica dual phase particles comprising the product of the carbon-silica dual phase particles and the diazonium salt of aniline substituted at the para-position with fluoro, $CF_3$, or $C_nH_{2n+1-y}F_y$, where y and n are as defined above.

Alternatively or in addition, the carbon-silica dual phase particles may be treated with an agent that associates preferentially with the silica surface, for example, a silica-treating agent. The silica-treating agent can be any suitable silica-treating agent and can be covalently bonded to the surface of the carbon-silica dual phase particles or can be present as a non-covalently bonded coating, which coating may also coat the carbon portion of the surface. Typically, the silica-treating agent is bonded either covalently or non-covalently to the silica-containing phase of the carbon-silica dual phase particles. In certain embodiments, the silica-treating agent can be a silicone fluid. The silicone fluid can be a non-functionalized silicone fluid or a functionalized silicone fluid. Non-limiting examples of useful non-functionalized silicone fluids include polydimethylsiloxanes, polydiethylsiloxanes, phenylmethylsiloxane copolymers, fluoroalkylsiloxane copolymers, diphenylsiloxane-dimethylsiloxane copolymers, phenylmethylsiloxane-dimethylsiloxane copolymers, phenylmethylsiloxane-diphenylsiloxane copolymers, methylhydrosiloxane-dimethylsiloxane copolymers, polyalkylene oxide modified silicones, cyclic polysiloxanes of the D3, D4, and D5 types, and the like. Depending on the conditions used to surface treat the carbon-silica dual phase particles and the particular silicone fluid employed, the silicone fluid may be present as a non-covalently bonded coating or may be covalently bonded to the surface of the particles.

Functionalized silicone fluids can comprise, for example, functional groups selected from the group consisting of vinyl, hydride, silanol, amino, and epoxy. The functional groups may be bonded directly to the silicone polymer backbone or may be bonded through intermediary alkyl, alkenyl, or aryl groups.

In certain embodiments, the silica-treating agent comprises a hydrophobizing silane. For example, the silica-treating agent can be a compound of the formula: $R_{4-n}SiX_n$ wherein n is 1-3, each R is independently selected from the group consisting of hydrogen, a $C_1$-$C_{18}$ alkyl group, a $C_3$-$C_{18}$ haloalkyl group, and a $C_6$-$C_{14}$ aromatic group, and each X is independently a $C_1$-$C_{18}$ alkoxy group or halo.

In certain embodiments, the silica-treating agent comprises a functionalized silane. The functionalized silane can comprise at least one functional group selected from the group consisting of acrylate, methacrylate, amino, anhydride, epoxy, halogen, hydroxyl, sulfur, vinyl, isocyanate, and combinations thereof.

In certain embodiments, the silica-treating agent comprises a silazane, for example, the silica-treating agent can be hexamethyldisilazane, octamethyltrisilazane, a cyclic silazane, and the like.

In certain embodiments, the silica-treating agent comprises a charge modifying agent such as one or more of those disclosed in U.S. Patent Application Publication 2010/0009280, the contents of which are incorporated herein by reference. Exemplary charge modifying agents include, but are not limited to, agents having the formula An—$Z_e$—$Y_b$—Ar(EW)$_a$, where Ar represents an aromatic group, EW represents an electron withdrawing group, Y represents a spacer group, Z represents an alkylene group, An represents an anchor group via which the charge modifying agent is attached to the surface, a is an integer from 1 to 5, b is 0 or 1, and c is 0 or 1. Specific charge modifying agents include, but are not limited to, 3-(2,4-dinitrophenylamino)propyltriethoxysilane (DNPS), 3,5-dinitrobenzamido-n-propyltriethoxysilane, 3-(triethoxysilylpropyl)-p-nitrobenzamide (TESPNBA), pentafluorophenyltriethoxysilane (PFPTES), and 2-(4-chlorosulfonylphenyl)ethyltrimethoxysilane (CSPES).

Alternatively or in addition, the dimethylsiloxane co-polymers disclosed in U.S. patent application Ser. No. 12/798,540, filed Apr. 6, 2010, the content of which is incorporated herein by reference, may be used to treat the carbon-silica dual phase particles. Exemplary dimethylsiloxane co-polymers include co-polymers of the formula:

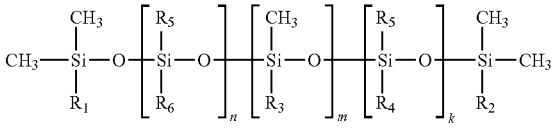

wherein $R_1$ is —H, —$CH_3$, $R_2$= —H, —$CH_3$, $R_3$=—$CH_3$, —$CH_2CH_3$, —$CH_2CH_2CH_3$, $CH_2Ar$, —$CH_2CH_2Ar$, —Ar, —$CH_2CH_2CF_3$, or —$CH_2CH_2$—$R_f$ with $R_f$ being a $C_1$ to $C_8$ perfluoroalkyl group, $R_4$ is —$CH_3$, —$CH_2CH_3$, —$CH_2CH_2CH_3$, —$CH_2CH_2CF_3$, or —$CH_2CH_2$—$R_f$ with $R_f$ being a $C_1$ to $C_8$ perfluoroalkyl group, $R_5$ is —$CH_3$, —$CH_2CH_3$, —$CH_2Ar$, —$CH_2CH_2Ar$, or —Ar, $R_6$ is —H, —OH, —$OCH_3$, or —$OCH_2CH_3$, Ar is unsubstituted phenyl or phenyl substituted with one or more methyl, halogen, ethyl, trifluoromethyl, pentafluoroethyl, or —$CH_2CF_3$ groups, n, m, and k are integer numbers, n≧1, m≧0, and k≧0, and wherein the co-polymer has a molecular weight from 208 to about 20,000.

The toner composition comprises, in addition to the aforesaid toner additive, a resin and a colorant. Typically, the resin and colorant are combined to form toner particles.

The colorant is not particularly limited and can be any suitable colorant. In certain embodiments, the colorant can be a pigment, which can be any suitable pigment, including any type of pigment conventionally used by those skilled in the art, such as black pigments and other colored pigments including blue, black, brown, cyan, green, white, violet, magenta, red, orange, or yellow pigments. Mixtures of different pigments can also be used. Representative examples of black pigments include various carbon blacks. These pigments can also be used in combination with a variety of different types of dispersants in order to form stable dispersions.

The colorant can have a wide range of BET surface areas, as measured by nitrogen adsorption, depending on the desired properties of the pigment. For example, the colorant may be a pigment having a surface area of about 10 $m^2/g$ or more (e.g., about 20 $m^2/g$ or more, or about 50 $m^2/g$ or more, or about 100 $m^2/g$ or more). Alternatively, or in addition, the colorant can have a surface area of about 600 $m^2/g$ or less (e.g., about 500

$m^2/g$ or less, or about 400 $m^2/g$ or less, or about 300 $m^2/g$ or less, or about 200 $m^2/g$ or less). Thus, the colorant can have a surface area bounded by any two of the above endpoints. For example, the colorant can have a surface area of about 10 $m^2/g$ to about 600 $m^2/g$ (e.g., about 10 $m^2/g$ to about 500 $m^2/g$, about 50 $m^2/g$ to about 500 $m^2/g$, about 100 $m^2/g$ to about 400 $m^2/g$, about 100 $m^2/g$ to about 500 $m^2/g$, about 100 $m^2/g$ to about 400 $m^2/g$, or about 100 $m^2/g$ to about 300 $m^2/g$). The colorant can also have a wide variety of primary particle sizes. For example, the colorant can have a primary particle size of about 5 nm or more (e.g., about 10 nm or more, about 15 nm or more, about 20 nm or more, or about 30 nm or more, or about 40 nm or more, or about 50 nm or more). Alternatively, or in addition, the colorant can have a primary particle size of about 250 nm or less (e.g., about 100 nm or less, or about 80 nm or less). Thus, the colorant can have a primary particle size bounded by any two of the above endpoints. For example, the colorant can have a primary particle size of about 5 nm to about 250 nm (e.g., about 10 nm to about 100 nm, or about 10 nm to about 80 nm, or about 15 nm to about 80 nm, or about 20 nm to about 100 nm). If, for example, a higher surface area for a pigment is not readily available for the desired application, it is also well recognized by those skilled in the art that the pigment may be subjected to conventional size reduction or comminution techniques, such as ball or jet milling, to reduce the pigment to a smaller particle size and an accompanying higher surface area, if desired.

The resin may be any suitable resin, many of which are known in the art. Suitable resin materials include, for example, polyamides, polyolefins, polycarbonates, styrene acrylates, styrene methacrylates, styrene butadienes, crosslinked styrene polymers, epoxies, polyurethanes, vinyl resins, including homopolymers or copolymers of two or more vinyl monomers, polyesters, and mixtures thereof. In particular, the resin may include homopolymers of styrene and its derivatives and copolymers thereof such as polystyrene, poly-p-chlorostyrene, polyvinyltoluene, styrene-p-chlorostyrene copolymers, styrene-vinyltoluene copolymers, copolymers of styrene and acrylic acid esters such as methyl acrylate, ethyl acrylate, n-butyl acrylate, and 2-ethylhexyl acrylate, copolymers of styrene and methacrylic acid esters such as methyl methacrylate, ethyl methacrylate, n-butyl methacrylate, and 2-ethylhexyl methacrylate, copolymers of styrene, acrylic acid esters, and methacrylic acid esters, or copolymers of styrene with other vinyl monomers such as acrylonitrile (e.g., styrene-acrylonitrile-indene copolymers), vinyl methyl ether, butadiene, vinyl methyl ketone, and maleic acid esters. The resin may also be a polymethyl methacrylate resin, polybutyl methacrylate resin, a polyvinyl acetate resin, a polyvinyl butyral resin, a polyacrylic acid resin, a phenolic resin, an aliphatic or alicyclic hydrocarbon resin, a petroleum resin, or a chlorin paraffin. The resin may also be a polyester resin, such as copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be halogen-substituted alkane), and alkylene glycol having from 1 to 4 carbon atoms in the alkylene moiety. Any of these resin types may be used either individually or as mixtures with these or other resins.

The resin is generally present in an amount between about 60% and about 95% by weight of the total toner composition. Generally, resins particularly suitable for use in xerographic toner manufacturing have a melting point in the range of between about 100° C. and about 135° C. and have a glass transition temperature (Tg) greater than about 60° C. (e.g., greater than about 70° C., or greater than about 80° C.).

The toner compositions of the invention may further comprise optional additives that may also be mixed with or blended into one or more of the components used to prepare these compositions, as described in more detail below. Examples include carrier additives, positive or negative charge control agents such as quaternary ammonium salts, pyridinium salts, sulfates, phosphates, and carboxylates, flow aid additives, silicone oils, and waxes such as commercially available polypropylenes and polyethylenes. Generally, these additives are present in amounts of from about 0.05% by weight to about 30% by weight; however, lesser or greater amounts of the additives may be selected depending on the particular system and desired properties.

The invention further provides a method of preparing a toner composition. The method comprises providing carbon-silica dual phase particles as described herein, providing resin particles comprising at least one colorant, wherein the resin particles have a surface, and combining the carbon-silica dual phase particles with the resin particles so that the carbon-silica dual phase particles become distributed on the surface of the resin particles, thereby providing a toner composition. Any suitable toner particles can be used in accordance with this method, and suitable toner particles are described above with respect to the toner composition of the invention. The method of preparing a toner composition optionally further comprises the addition of other components as described herein to the mixture of the toner particles and the carbon-silica dual phase particles.

Conventional equipment for dry blending of powders can be used for mixing or blending the carbon-silica dual phase particles with toner particles to form a toner composition.

The toner composition can be prepared by a number of known methods, such as admixing and heating the carbon-silica dual phase particles, the colorants, the binder resin, and optional charge-enhancing additives and other additives in conventional toner extrusion devices and related equipment. Other methods include spray drying, melt dispersion, extrusion processing, dispersion polymerization, and suspension polymerization, optionally followed by mechanical attrition and classification to provide toner particles having a desired average size and a desired particle size distribution.

The toner composition can be used alone in mono-component developers or can be mixed with suitable dual-component developers. The carrier vehicles which can be used to form developer compositions can be selected from various materials. Such materials typically include carrier core particles and core particles overcoated with a thin layer of film-forming resin to help establish the correct triboelectric relationship and charge level with the toner employed. Suitable carriers for two-component toner compositions include iron powder, glass beads, crystals of inorganic salts, ferrite powder, and nickel powder, all of which are typically coated with a resin coating such as an epoxy or fluorocarbon resin.

Desirably, the toner additive alters the tribocharging ability of the toner composition while remaining stable with respect to changes in humidity. Tribocharge refers to the accumulation of static charge as two unlike materials, rub together. For example, in a dual component developer, friction between the toner particles and the carrier particles results in the accumulation charge on the toner.

EXAMPLES

The following examples further illustrate the invention but, of course, should not be construed as in any way limiting its scope.

CSDP-1, CSDP-2, and CSDP-3 carbon-silica dual phase particles produced by Cabot Corporation (Billerica, Mass.) were used in the experiments described in the Examples. Selected physical parameters of the carbon-silica dual phase particles including iodine number, structure as expressed by oil absorption number ("OAN") or compressed oil absorption number ("COAN"), and silica coverage are set forth in Table 1. The oil absorption number and compressed oil absorption number can be determined using ASTM standard test methods. The silica coverage expressed as the percent of the particle surface area comprising silica is calculated from the BET surface area ("BETSA") and the surface area as determined by iodine adsorption ("ISA") by the expression: [(BETSA–ISA)/(BETSA)]×100%.

TABLE 1

Selected Properties of CSDP-1, CSDP-2, and CSDP-3 carbon-silica dual phase particles

| Particle | Iodine Number | Structure | Silica Coverage (%) |
|---|---|---|---|
| CSDP-1 | 61.5 | OAN = 143 | 54 |
| CSDP-2 | 24 | OAN = 127 | 81 |
| CSDP-3 | 62 | COAN = 108 | 55 |

Example 1

This example demonstrates the preparation of a toner additive useful in accordance with an embodiment of the invention.

A 250 mL round bottom flask equipped with thermocouple, condenser, and overhead stirring motor was charged with 200 mL of isopropanol, 100 mL of de-ionized water, 30 g of CSDP-1 carbon-silica dual phase particles, and 10.3 g (0.064 mol) of hexamethyldisilazane (HMDZ). The reaction mixture was heated to 70° C. and kept at this temperature for 6 h, after which it was transferred to a PYREX™ glass tray and dried overnight in a forced air oven at 120° C. The resulting dry black powder was milled using a high-speed laboratory grinder.

Example 2

This example demonstrates the preparation of a toner additive useful in accordance with an embodiment of the invention.

A 250 mL round bottom flask equipped with thermocouple, condenser, and overhead stirring motor was charged with 200 mL of isopropanol, 100 mL of de-ionized water, and 30 g of CSDP-1 carbon-silica dual phase particles. The pH of the dispersion was adjusted to 10 by adding a few drops of concentrated solution of ammonium hydroxide. 1.5 g of methylhydrosiloxane-dimethylsiloxane copolymer (copolymer number average molecular weight $M_n$=1950, viscosity 25-35 cSt, copolymer contains 25-30 mol % of [$CH_3$—Si—H] units) was added, and the mixture was heated to 70° C. and allowed to react overnight (approximately 16 h). Subsequently 3 g (0.019 mol) of HMDZ was added and allowed to react for 5 h, after which the dispersion was transferred to a PYREX™ glass tray and dried overnight in a forced air oven at 120° C. The resulting dry black powder was milled using a high-speed laboratory grinder.

Example 3

This example demonstrates the preparation of a toner additive useful in accordance with an embodiment of the invention.

A 250 mL round bottom flask equipped with thermocouple, condenser, and overhead stirring motor was charged with 150 mL of isopropanol, 100 mL of de-ionized water, and 20 g of CSDP-1 carbon-silica dual phase particles. The pH of the dispersion was adjusted to 9.5 by adding few drops of concentrated solution of ammonium hydroxide. 4 g (0.017 mol) of octyltrimethoxysilane was then added, and the mixture was heated to 70° C. for 6 h, after which the slurry was transferred to a PYREX™ glass tray and dried overnight in a forced air oven at 120° C. The resulting dry black powder was milled using a high-speed laboratory grinder.

Example 4

This example demonstrates the preparation of a toner additive useful in accordance with an embodiment of the invention.

A 1 L round bottom flask equipped with thermocouple, condenser, and overhead stirring motor was charged with 400 mL of de-ionized water, 40 g of CSDP-1 carbon-silica dual phase particles, 2.07 g of 4-fluoroaniline, and 5.99 g of methanesulfonic acid (30% solution in water). The temperature of the mixture was increased to 65° C., and 4.3 g of sodium nitrite solution (30% in water) was added dropwise over 15 min. The resulting mixture was allowed to react for 1 h, after which it was filtered under suction. The filter cake was washed with water several times until the filtrate was colorless. The black solid was collected and dried overnight in a forced air oven at 120° C. The resulting dry black powder was milled using a high-speed laboratory grinder.

Example 5

This example demonstrates the preparation of a toner additive useful in accordance with an embodiment of the invention.

A 250 mL round bottom flask equipped with a thermocouple, condenser, and overhead stirring motor was charged with 133 mL of isopropanol, 67 mL of de-ionized water, and 20 g of CSDP-1 carbon-silica dual phase particles treated with 4-fluoroaniline as described in Example 4. The pH of the dispersion was brought to 9.1 by adding few drops of concentrated solution of ammonium hydroxide. 10.3 g (0.064 mol) of HMDZ was added, and the mixture was heated to 70° C. for 6 h, after which it was transferred to a PYREX™ glass tray and dried overnight in a forced air oven at 120° C. The resulting dry black powder was milled using a high-speed laboratory grinder.

Example 6

This example illustrates the thermal behavior of toner additives useful in accordance with certain embodiments of the invention.

Additives 6A-6C, which were prepared by the methods of Examples 1-3, respectively, were characterized by thermogravimetric analysis (TGA) in a typical TGA experiment. In particular, each toner additive was heated in a $N_2$ atmosphere from room temperature to 110° C. with a temperature ramp rate of 10° C./min, kept at 110° C. for 30 min, heated from 110 to 800° C. with a temperature ramp rate of 20° C./min, kept at 800° C. in $N_2$ for 15 min after which $N_2$ was changed to air, and then allowed to cool down. CSDP-1 carbon-silica dual phase particles served as the comparative example.

The results of the TGA measurements are set forth in Table 2.

TABLE 2

Summary of TGA data for untreated and treated carbon-silica dual phase particles.

| Sample | Untreated CSDP-1 | Additive 6A | Additive 6B | Additive 6C |
|---|---|---|---|---|
| wt. loss @ 110° C. (wt. %) | 1.3 | 0.57 | 0.63 | 0.63 |
| wt. loss @ 800° C. (wt. %) | 1.45 | 3.59 | 3.17 | 4.69 |

As is apparent from the results set forth in Table 2, the products of Examples 1-3 exhibited less weight loss when heated at 110° C. than did the untreated carbon-silica dual phase particles and greater weight loss when heated at 800° C. than did the untreated carbon-silica dual phase particles. The weight loss at 110° C. was attributed to loss of adsorbed water from the treated and untreated carbon-silica dual phase particles. The weight loss at 800° C. was attributed to decomposition of the chemical treatment on the silica surface.

Example 7

This example illustrates the methanol wettability of toner additives useful in certain embodiments of the invention.

Samples of untreated CSDP-1 carbon-silica dual phase particles, CSDP-1 carbon-silica dual phase particles treated with HMDZ as described in Example 1, and CSDP-1 carbon-silica dual phase particles treated with PDMS copolymer/HMDZ as described in Example 2 were subject to the methanol wettability test.

Eleven vials containing 10 mL of methanol/water solutions, each with a different vol. % of methanol from 0 to 100% in 10% increments, were prepared for each test. 0.001 g of each sample was dispersed in each vial, the mixtures were allowed to stand still for approximately 3 hours, and then the observations were recorded.

Untreated CSDP-1 carbon-silica dual phase particles were equally well wetted by pure methanol and by pure water.

CSDP-1 carbon-silica dual phase particles treated with HMDZ floated on the surface of pure water with the water phase being completely transparent. A uniform dispersion of CSDP-1 carbon-silica dual phase particles treated with HMDZ was achieved only in a solution containing 50 vol. % of methanol.

CSDP-1 carbon-silica dual phase particles treated with PDMS copolymer/HMDZ behaved similar to CSDP-1 carbon-silica dual phase particles treated with HMDZ alone. A good dispersion of CSDP-1 carbon-silica dual phase particles treated with PDMS copolymer/HMDZ was obtained in a solution containing 60 vol. % of methanol.

These observations indicate that the treatments described in Example 1 and 2 were successful in increasing the hydrophobicity of the carbon-silica dual phase particles.

Example 8

This example evaluates tribocharge of the toner additives prepared according to Examples 1-5.

Electrostatic charge (tribocharge) measurements were performed using the blow-off method which is a generally accepted method in the field of electrophotography. The measurements were performed with black polyester chemical toner (particle size 8-12 μm, supplied by Sinonar Inc.). Chemical toner samples were formulated with 4 wt. % of treated or untreated carbon-silica dual phase particles. Toners and carbon-silica dual particles were mixed in a laboratory blender for 3 min. The blender was operated in pulse mode (1 s blender on and 4 s blender off) to keep the toner from being heated above its glass transition temperature.

Developers were prepared by mixing 2 wt. % of the formulated toner with a silicone resin coated Cu—Zn ferrite carrier (60-90 μm particle size, purchased from Powdertech Co., Ltd.). Developers were conditioned overnight in temperature and humidity controlled chamber at 15% RH/18° C. (LL condition) or 80% RH/30° C. (HH condition).

After conditioning, the developers were placed in glass jars and charged by rolling for 30 min at 185 rpm on a roll mill. The triboelectrostatic charge measurements were done using a Vertex T-150 tribocharge tester, manufactured by Vertex Image Products, Inc., Yukon, Pa. The sample is placed inside a Faraday cage and a high pressure air jet is used to blow off the toner from the carrier. The carrier retains the opposing charge of the toner particles Tribocharge measurements were obtained for Additives 8A-8H. Additives 8A and 8B (comparative) were two samples of hydrophobically treated titanium dioxide. Additive 8C (invention) was untreated CSDP-1. Additives 8D-8H (invention) were the toner additives described in Example 1-5, respectively. The tribocharging measurements provided absolute values in charge per mass at low temperature and low humidity ("LL") (18° C., 15% relative humidity) and at high temperature and high humidity ("HH") (35° C., 80% relative humidity). The ratio HH/LL is a measure of environmental stability. Each measurement was repeated three times, and the average measurement and the standard deviation are set forth in Table 3.

TABLE 3

Tribocharge values for treated titanium dioxide and treated and untreated carbon-silica dual phase particles.

| Composition | Additive | HH | LL | HH/LL |
|---|---|---|---|---|
| 8A | $TiO_2$ | −33(2) | −44(4) | 0.75 |
| 8B | $TiO_2$ | −36(1) | −41(1) | 0.88 |
| 8C | CSDP-1 | −26(1) | −41(2) | 0.63 |
| 8D | Ex. 1 | −31(2) | −39(2) | 0.79 |
| 8E | Ex. 2 | −25(1) | −43(5) | 0.58 |
| 8F | Ex. 3 | −25(1) | −38(1) | 0.66 |
| 8G | Ex. 4 | −30(4) | −41(2) | 0.73 |
| 8H | Ex. 5 | −34(1) | −46(1) | 0.74 |

The results of the tribocharge measurements show that (i) the tribocharge of the untreated carbon-silica dual phase particles (Additive 8C) is relatively close to the tribocharge of the hydrophobically treated carbon-silica dual phase particles (Additives 8D-8H) and (ii) carbon-silica dual phase particles (Additives 8C-8H) have tribocharge and tribocharge humidity sensitivity (HH/LL) in approximately the same range as hydrophobically treated titanium dioxide (Additives 8A and 8B), which is commonly used as an external additive in toner formulations.

Example 9

This example demonstrates the tribocharge and free flow characteristics of untreated and treated carbon-silica dual phase particles formulated with polyester resin toner particles.

Six different toner compositions (Compositions 9A-9F) were prepared by combining six different toner additives with polyester resin toner particles according to the procedure described in Example 8 (the amount of additive in the toner is given below). The toner additives comprised CSDP-2 or CSDP-3 carbon-silica dual phase particles, produced by Cabot Corporation, which were either untreated or treated with surface treating agents. Composition 9A contained 1 wt. % of untreated CSDP-2 carbon-silica dual phase particles. Composition 9B contained 1 wt. % of CSDP-2 carbon-silica dual phase particles treated with 15 wt. % polydimethylsiloxane. Composition 9C contained 4 wt. % of CSDP-2 carbon-silica dual phase particles treated with 15 wt. % polydimethylsiloxane. Composition 9D contained 4 wt. % of untreated CSDP-3 carbon-silica dual phase particles. Composition 9E contained 1 wt. % of CSDP-3 carbon-silica dual phase particles treated with 15 wt. % polydimethylsiloxane. Composition 9F contained 4 wt. % of CSDP-3 carbon-silica dual phase particles treated with 15 wt. % polydimethylsiloxane.

Developer was prepared with each of Compositions 9A-9F according to the procedure described in Example 8. Tribocharge measurements at high temperature-high humidity ("HH") and low temperature-low humidity ("LL") conditions using the procedure described in Example 8. Each measurement was repeated three times, and the average measurement is set forth in Table 4.

TABLE 4

Tribocharge values for treated and untreated carbon-silica dual phase particles.

| Composition | Additive | wt. % | PDMS | HH | LL | HH/LL |
|---|---|---|---|---|---|---|
| 9A | CSDP-2 | 1 | 0% | −19 | −23 | 0.83 |
| 9B | CSDP-2 | 1 | 15% | −16 | −17 | 0.94 |
| 9C | CSDP-2 | 4 | 15% | −22 | −22 | 1.0 |
| 9D | CSDP-3 | 4 | 0% | −31 | −44 | 0.70 |
| 9E | CSDP-3 | 1 | 15% | −24 | −28 | 0.86 |
| 9F | CSDP-3 | 4 | 15% | −24 | −23 | 1.0 |

The results of the tribocharge measurements show that the charge level and charge humidity sensitivity of the carbon-silica dual phase particles are close to those for treated titania.

Example 10

This example demonstrates the tribocharge characteristics of untreated and treated carbon-silica dual phase particles formulated with polyester resin toner particles.

Three different toner compositions (Compositions 10A-10C) were prepared by combining three different toner additives with polyester resin toner particles as described in Example 8 (the amount of additive in the toner is set out below). The toner additives comprised CSDP-2 carbon-silica dual phase particles produced by Cabot Corporation, which were treated with surface treating agents. Composition 10A contained 4 wt. % of CSDP-2 carbon-silica dual phase particles treated with HMDZ. Composition 10B contained 4 wt. % of CSDP-2 carbon-silica dual phase particles treated with 15 wt. % octyltrimethoxysilane. Composition 10C contained 4 wt. % of CSDP-2 carbon-silica dual phase particles treated with 12 wt. % trifluoropropyltrimethoxysilane.

Tribocharge measurements at high temperature-high humidity ("HH") and normal temperature-normal humidity ("NN") conditions (23° C., 50% humidity) were determined for each of Compositions 10A-10C using the procedures described in Example 8. Each measurement was repeated three times, and the average measurement is set forth in Table 5.

TABLE 5

Tribocharge for treated carbon-silica dual phase particles.

| Composition | HH | NN |
|---|---|---|
| 10A | −9 | −17 |
| 10B | −21 | −25 |
| 10C | −26 | −35 |

Comparative Example

Toner was prepared with two commercially available silica additives, Cab-O-Sil® TG-810G (fumed silica ~320 $m^2/g$ surface area, treated with HMDZ, available from Cabot Corporation) and Cab-O-Sil™ TG-C413 (colloidal silica ~60 $m^2/g$ surface area, treated with HMDZ, available from Cabot Corporation) using the procedure described in Example 8 (the amount of additive in the toner is listed in Table 6). Tribocharge measurements at high temperature-high humidity ("HH") and low temperature-low humidity ("LL") conditions using the procedure described in Example 8. Each measurement was repeated three times, and the average measurement is set forth in Table 6.

TABLE 6

| Grade | Loading on toner (wt %) | Calculated surface coverage | HH | LL | HH/LL |
|---|---|---|---|---|---|
| TG-810G | 0.5 | 75% | −44 | −92 | 0.48 |
| TG-C413 | 4.0 | 110% | −39 | −81 | 0.48 |

The results agree with typical HH/LL values for treated silicas, which range from about 0.4 to about 0.5. The results show that composite particles incorporating both carbon black and silica exhibit superior environmental tribocharge stability in comparison to silica particles.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A toner composition comprising resin particles, a colorant, and a toner additive, wherein the toner additive comprises carbon-silica dual phase particles, wherein the carbon-silica dual phase particles comprise aggregates of carbon black comprising at least one silicon-containing region, and wherein the carbon-silica dual phase particles are distributed on the surface of the resin particles.

2. The toner composition of claim 1, wherein at least one organic group is attached to the carbon-silica dual phase particles.

3. The toner composition of claim 2, wherein the at least one organic group is selected from the group consisting of an aliphatic group, an aromatic group, a heterocyclic group, and a heteroaryl group.

4. The toner composition of claim 3, wherein the at least one organic group is substituted with a moiety selected from the group consisting of R, OR, COR, COOR, OCOR, X, $CX_3$, $C_nH_{2n+1-y}X_y$, where n is 1 to 5, y is 1 to 2n+1, and X is halogen, CN, $NR_2$, $SO_2NR(COR)$, $SO_2NR_2$, NR(COR), $CONR_2$, $NO_2$, $SO_3M$ (wherein M is H, Li, Na, Cs, or K), $SO_3NR_4^+$, and N═NR', where R is independently hydrogen, $C_1$-$C_{20}$ substituted or unsubstituted alkyl (branched or unbranched), $C_2$-$C_{20}$ substituted or unsubstituted alkenyl, $(C_2\text{-}C_4 \text{ alkyleneoxy})_xR''$, wherein x is 1 to 40, or a substituted or unsubstituted aryl, R' is independently hydrogen, $C_1$-$C_{20}$ substituted or unsubstituted alkyl (branched or unbranched), or a substituted or unsubstituted aryl, and R" is hydrogen, a $C_1$-$C_{20}$ substituted or unsubstituted alkyl, a $C_3$-$C_{20}$ substituted or unsubstituted alkenyl, a $C_1$-$C_{20}$ substituted or unsubstituted alkanoyl, and a substituted or unsubstituted aroyl.

5. The toner composition of claim 3, wherein the organic group is substituted with a moiety selected from the group consisting of fluoro, $CF_3$, or $C_nH_{2n+1-y}F_y$, wherein n is 1 to 5 and y is 1 to 2n−1.

6. The toner composition of claim 1, wherein the carbon-silica dual phase particles have been treated with a surface-treating agent that is associated with the at least one silicon-containing region.

7. The toner composition of claim 6, wherein the surface-treating agent comprises a silicone fluid.

8. The toner composition of claim 7, wherein the silicone fluid comprises a non-functionalized silicone fluid.

9. The toner composition of claim 8, wherein the non-functionalized silicone fluid is selected from the group consisting of polydimethylsiloxanes, polydiethylsiloxanes, phenylmethylsiloxane copolymers, fluoroalkylsiloxane copolymers, diphenylsiloxane-dimethylsiloxane copolymers, phenylmethylsiloxane-dimethylsiloxane copolymers, phenylmethylsiloxane-diphenylsiloxane copolymers, methylhydrosiloxane-dimethylsiloxane copolymers, polyalkylene oxide modified silicones, and cyclic polysiloxanes.

10. The toner composition of claim 7, wherein the surface-treating agent comprises a functionalized silicone fluid.

11. The toner composition of claim 10, wherein the functionalized silicone fluid comprises functional groups selected from the group consisting of vinyl, hydride, silanol, amino, and epoxy.

12. The toner composition of claim 6, wherein the surface-treating agent comprises a hydrophobizing silane.

13. The toner composition of claim 12, wherein the hydrophobizing silane has the general formula $R_{4-n}$, $SiX_n$ wherein n is 1-3, each R is independently selected from the group consisting of hydrogen, a $C_1$-$C_{18}$ alkyl group, a $C_3$-$C_{18}$ haloalkyl group, and a $C_6$-$C_{14}$ aromatic group, and each X is independently a $C_1$-$C_{18}$ alkoxy group or halo.

14. The toner composition of claim 6, wherein the surface-treating agent comprises a functionalized silane.

15. The toner composition of claim 14, wherein the functionalized silane comprises at least one functional group selected from the group consisting of acrylate, methacrylate, amino, anhydride, epoxy, halogen, hydroxyl, sulfur, vinyl, and isocyanate, and combinations thereof.

16. The toner composition of claim 6, wherein the surface-treating agent comprises a silazane.

17. The toner composition of claim 1, wherein the toner composition comprises about 0.1 wt. % to about 5 wt. % of the toner additive.

18. The toner composition of claim 1, wherein the colorant is at least one pigment selected from the group consisting of carbon black, magnetites, and combinations thereof.

19. A method of preparing a toner composition, which method comprises (a) providing carbon-silica dual phase particles, wherein the carbon-silica dual phase particles comprise aggregates of carbon black comprising at least one silicon-containing region, (b) providing resin particles comprising at least one colorant, wherein the resin particles have a surface, and (c) combining the carbon-silica dual phase particles with the resin particles so that the carbon-silica dual phase particles become distributed on the surface of the resin particles, thereby providing a toner composition.

20. The method of claim 19, wherein at least one organic group is attached to the carbon-silica dual phase particles.

21. The method of claim 20, wherein the at least one organic group is substituted with a moiety selected from the group consisting of R, OR, COR, COOR, OCOR, X, $CX_3$, $C_nH_{2n+1-y}X_y$, where n is 1 to 5, y is 1 to 2n+1, and X is halogen, CN, $NR_2$, $SO_2NR(COR)$, $SO_2NR_2$, NR(COR), $CONR_2$, $NO_2$, $SO_3M$ (wherein M is H, Li, Na, Cs, or K), $SO_3NR_4^+$, and N═NR', where R is independently hydrogen, $C_1$-$C_{20}$ substituted or unsubstituted alkyl (branched or unbranched), $C_2$-$C_{20}$ substituted or unsubstituted alkenyl, $(C_2\text{-}C_4 \text{ alkyleneoxy})_xR''$, wherein x is 1 to 40, or a substituted or unsubstituted aryl, R' is independently hydrogen, $C_1$-$C_{20}$ substituted or unsubstituted alkyl (branched or unbranched), or a substituted or unsubstituted aryl, and R" is hydrogen, a $C_1$-$C_{20}$ substituted or unsubstituted alkyl, a $C_3$-$C_{20}$ substituted or unsubstituted alkenyl, a $C_1$-$C_{20}$ substituted or unsubstituted alkanoyl, and a substituted or unsubstituted aroyl.

22. The method of claim 20, wherein the organic group is substituted with a moiety selected from the group consisting of fluoro, $CF_3$, or $C_nH_{2n+1-y}F_y$, wherein n is 1 to 5 and y is 1 to 2n−1.

23. The method of claim 19, wherein the carbon-silica dual phase particles have been treated with a surface-treating agent that is associated with the at least one silicon-containing region.

24. The method of claim 23, wherein the surface-treating agent comprises a silicone fluid.

25. The method of claim 23, wherein the surface-treating agent comprises a hydrophobizing silane.

26. The method of claim 25, wherein the hydrophobizing silane has the general formula $R_{4-n}SiX_n$ wherein n is 1-3, each R is independently selected from the group consisting of hydrogen, a $C_1$-$C_{18}$ alkyl group, a $C_3$-$C_{18}$ haloalkyl group, and a $C_6$-$C_{14}$ aromatic group, and each X is independently a $C_1$-$C_{18}$ alkoxy group or halo.

27. The method of claim 23, wherein the surface-treating agent comprises a functionalized silane.

28. The method of claim 27, wherein the functionalized silane comprises at least one functional group selected from the group consisting of acrylate, methacrylate, amino, anhydride, epoxy, halogen, hydroxyl, sulfur, vinyl, and isocyanate, and combinations thereof.

29. The method of claim 23, wherein the surface-treating agent comprises a silazane.

30. The method of claim 19, wherein the toner composition comprises about 0.1 wt. % to about 5 wt. % of the carbon-silica dual phase particles.

* * * * *